US008331604B2

(12) United States Patent
Saito et al.

(10) Patent No.: US 8,331,604 B2
(45) Date of Patent: Dec. 11, 2012

(54) ELECTRO-ACOUSTIC CONVERSION APPARATUS

(75) Inventors: Kazuyuki Saito, Hamura (JP); Toshifumi Yamamoto, Hino (JP); Norikatsu Chiba, Kawasaki (JP); Yasuhiro Kanishima, Ome (JP); Takashi Fukuda, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 387 days.

(21) Appl. No.: 12/693,804

(22) Filed: Jan. 26, 2010

(65) Prior Publication Data

US 2010/0316225 A1 Dec. 16, 2010

(30) Foreign Application Priority Data

Jun. 12, 2009 (JP) ..... 2009-141506

(51) Int. Cl.
*H04R 25/00* (2006.01)
*H04R 1/02* (2006.01)
*H04R 9/06* (2006.01)

(52) U.S. Cl. ..... 381/380; 381/328; 381/338; 381/361; 381/375; 181/130; 181/135

(58) Field of Classification Search ..... 381/322, 381/324, 326, 328, 162, 163, 355, 338, 361, 381/367, 370, 371, 375, 380, 382; 181/130, 181/135; 607/57; 660/25; D14/206, 223
See application file for complete search history.

(56) References Cited

U.S. PATENT DOCUMENTS

| | | | | |
|---|---|---|---|---|
| 3,819,860 | A * | 6/1974 | Miller | 381/380 |
| 4,588,867 | A * | 5/1986 | Konomi | 379/430 |
| 4,852,177 | A * | 7/1989 | Ambrose | 381/338 |
| 5,208,867 | A * | 5/1993 | Stites, III | 381/361 |
| 5,692,059 | A * | 11/1997 | Kruger | 381/151 |
| 5,748,743 | A * | 5/1998 | Weeks | 381/328 |
| 6,327,370 | B1 * | 12/2001 | Killion et al. | 381/313 |
| 7,245,733 | B2 * | 7/2007 | Saltykov | 381/322 |
| 7,263,195 | B2 * | 8/2007 | Harvey et al. | 381/328 |
| 7,424,122 | B2 * | 9/2008 | Ryan | 381/322 |
| 7,957,549 | B2 * | 6/2011 | Chiba et al. | 381/328 |
| 7,991,179 | B2 * | 8/2011 | Drambarean et al. | 381/380 |
| 8,130,995 | B2 * | 3/2012 | Her et al. | 381/380 |
| 2008/0181440 | A1 * | 7/2008 | Saltykov | 381/328 |

FOREIGN PATENT DOCUMENTS

| | | |
|---|---|---|
| JP | 3-214893 A | 9/1991 |
| JP | 06189388 A | 7/1994 |

(Continued)

OTHER PUBLICATIONS

Japanese Office Action for Japanese Patent Application 2011-094204 dated Jul. 26, 2011.
Japanese Office Action for Japanese Patent Application 2009-141506 dated Mar. 23, 2010.

*Primary Examiner* — Xu Mei
(74) *Attorney, Agent, or Firm* — Patterson & Sheridan, LLP

(57) ABSTRACT

According to one embodiment, A microphone-earphone includes a speaker connected to an acoustic device configured to measure acoustic characteristics of a listener's external auditory canal, and configured to output an acoustic signal toward the listener's external auditory canal, a microphone device disposed outside the listener's external auditory canal, an acoustic tube including one end connected to the microphone device and the other end opening to the listener's external auditory canal, and a housing including an opening portion which accommodates the speaker and is so disposed as to guide sound, which is output from the speaker, to the listener's external auditory canal. An inside diameter of the acoustic tube is less than a diameter of the opening portion.

8 Claims, 6 Drawing Sheets

FOREIGN PATENT DOCUMENTS

| | | | |
|---|---|---|---|
| JP | 11136331 | A | 5/1999 |
| JP | 2000050375 | A | 2/2000 |
| JP | 2000-92589 | A | 3/2000 |
| JP | 2007201887 | A | 8/2007 |
| JP | 2007-243739 | A | 9/2007 |
| JP | 2007-281916 | A | 10/2007 |
| JP | 2008-177798 | A | 7/2008 |
| JP | 2009-21826 | A | 1/2009 |

* cited by examiner

ELECTRO-ACOUSTIC CONVERSION APPARATUS

CROSS-REFERENCE TO RELATED APPLICATIONS

This application is based upon and claims the benefit of priority from Japanese Patent Application No. 2009-141506, filed Jun. 12, 2009, the entire contents of which are incorporated herein by reference.

BACKGROUND

1. Field

One embodiment of the present invention relates to an apparatus (hereinafter referred to as "microphone-earphone") which comprises a device for converting sound (acoustic signal) to an electric signal, is worn on the ear in use, and converts an electric signal to sound, and more particularly to a microphone-earphone configured to correct acoustic characteristics of the external auditory canal.

2. Description of the Related Art

Playback apparatuses, which enable listening of playback sound, such as music, with use of a headphone or an earphone, have being gaining in popularity. When music is listened to with use of a headphone or an earphone, there is such a case that the ear is closed by the headphone or earphone and a resonance phenomenon occurs, and the sound quality becomes unnatural due to the resonance phenomenon.

There has conventionally been proposed an earphone which includes a microphone-equipped earphone in order to achieve out-of-head sound image localization, wherein the acoustic characteristics of the external auditory canal are obtained by measurement using the microphone-equipped earphone, and a transfer function is found by using an adaptive equalization filter (Jpn. Pat. Appln. KOKAI Publication No. 2000-92589).

On the other hand, when music is listened to with the headphone or earphone, there is such a case that the playback sound deteriorates due to sound from the outside environment. In the prior art, there has been proposed a technique of noise cancellation for preventing deterioration of playback sound due to sound from the outside environment.

Jpn. Pat. Appln. KOKAI Publication No. H3-214893, for instance, discloses an earphone apparatus comprising an acoustic tube configured to have substantially the same inside diameter as the external auditory canal, and to have one end formed as an earlap decorative portion and the other end formed as a voice non-reflective end; an external microphone unit; an internal microphone unit; and a mixing circuit which can vary a mixture ratio between a signal obtained from the external microphone unit and a signal obtained from the internal microphone unit. The mixture ratio of the mixing circuit is varied, where necessary. Thereby, outside sound, etc. can be listened to, without removing the earphone apparatus from the ear, and noise from the outside is reduced (see Jpn. Pat. Appln. KOKAI Publication No. H3-214893).

In addition, Jpn. Pat. Appln. KOKAI Publication No. 2008-177798 discloses an earphone apparatus for exactly measuring the acoustic characteristics of the external auditory canal, with the earphone apparatus being worn on the ear. The earphone apparatus is put on a part of the listener's earlap, and a sound image is output from a moving-coil type sound source, which is provided in the housing, toward the listener's eardrum. A second sound source, apart from a first sound source, is provided in the housing.

In the technique disclosed in the above-described KOKAI No. 2000-92589, however, if the microphone is disposed between the speaker of the earphone and the external auditory canal, the sound output from the speaker is blocked by the microphone, and the playback sound is degraded. In some cases, when the acoustic characteristics of the external auditory canal are obtained, a signal output from the speaker is disadvantageously acquired.

In the above-described KOKAI No. 2008-177798, in order to advance the technique in KOKAI No. 2000-92589, the second sound source is used as a sound source for measurement, and the first sound source is used as a microphone. In this technique, however, it is necessary to use the second sound source that is limited to the use for measurement, and it is difficult to provide the commodity value commensurate with the increase in system cost. Besides, depending on the kind of sound that is used for measurement, since the first sound source is disposed in front of the second sound source, the measured sound is blocked and the exact characteristics are hardly measured.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, there is provided a microphone-earphone comprising: a speaker connected to an acoustic device having a function of measuring acoustic characteristics of a listener's external auditory canal, and configured to output an acoustic signal toward the listener's external auditory canal; a microphone device disposed outside the listener's external auditory canal; an acoustic tube having one end connected to the microphone device and the other end opening to the listener's external auditory canal; and a housing including an opening portion which accommodates the speaker and is so disposed as to guide sound, which is output from the speaker, to the listener's external auditory canal, wherein an inside diameter of the acoustic tube is less than a diameter of the opening portion.

Figure 1:
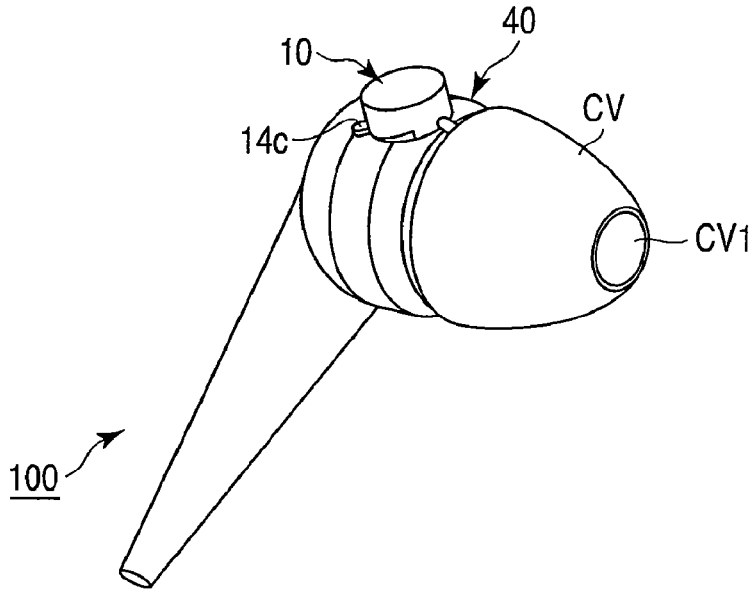
FIG. 1 is an exemplary view for describing a structure example of a microphone-earphone according to an embodiment of the present invention.

A microphone-earphone 100 according to an embodiment of the present invention will now be described with reference to the accompanying drawings. As shown in FIG. 1, the microphone-earphone 100 according to the embodiment comprises an ear chip CV which is inserted in the external auditory canal, a housing 40 to which the ear chip CV is attached, and an acoustic signal input/output module INTF which is connected to a sound source (not shown). The housing 40 includes a cavity portion and an opening portion. The housing 40 is configured to lead sound from the cavity portion toward the opening portion as descried blow.

The ear chip CV includes an opening portion CV1 which opens to the external auditory canal. A microphone device 10 is attached to the outer surface of the housing 40. When a user wears the microphone-earphone 100 on the external auditory canal, the microphone device 10 is disposed outside the external auditory canal and exposed to the outside environment. In other words, the microphone device 10 is disposed outside an acoustic signal propagation path which is formed by the housing 40 between the listener's external auditory canal and the microphone device 10.

The diameter of that part of the ear chip CV, which is attached to the housing 40, is set to correspond to the inside diameter of the external auditory canal, so that the ear chip CV is held in the external auditory canal in the state in which the microphone-earphone 100 is put on the user's external auditory canal.

Figure 2:
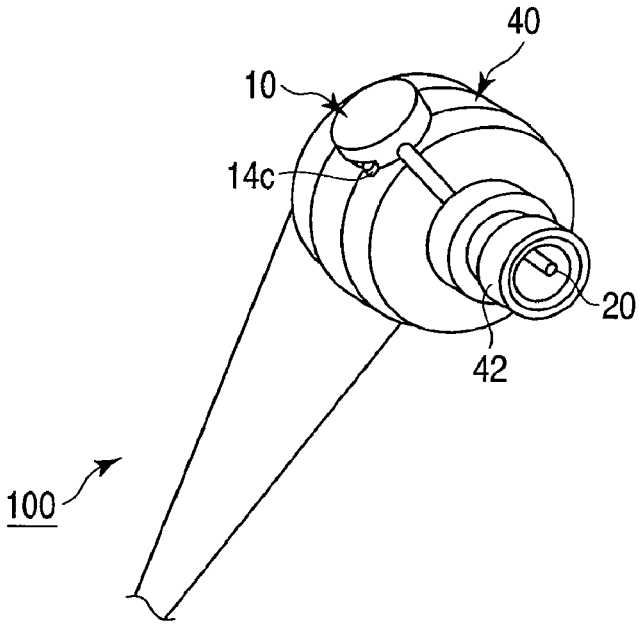
FIG. 2 is an exemplary view for describing a structure example of the microphone-earphone shown in FIG. 1, with an ear chip being removed.

FIG. 2 shows the state in which the ear chip CV of the microphone-earphone 100 shown in FIG. 1 is removed. As shown in FIG. 2, one end of an acoustic tube 20 is connected to the microphone device 10. The other end 20E of the acoustic tube 20 extends into the external auditory canal and is open to the external auditory canal.

Figure 3:
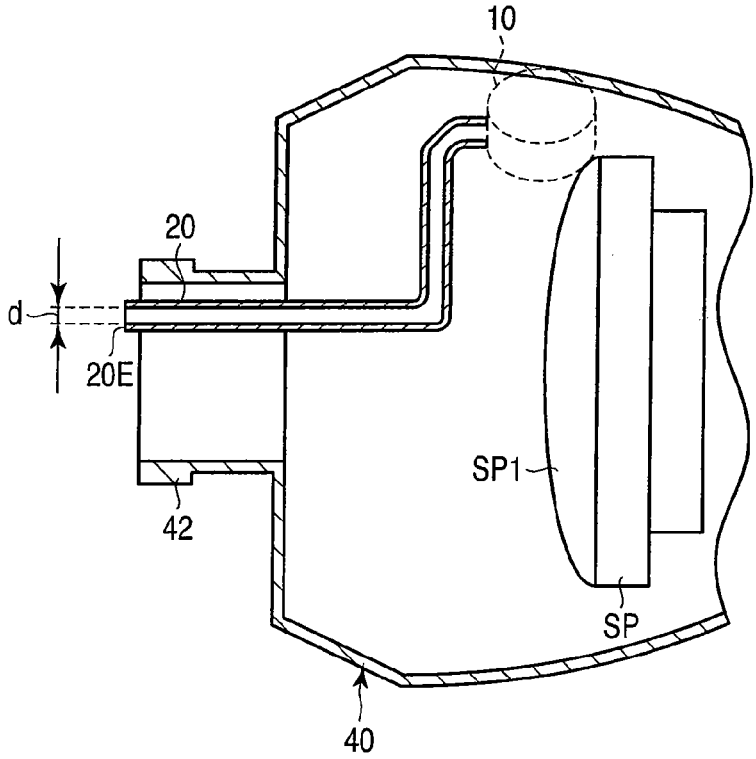
FIG. 3 is an exemplary cross-sectional view for describing a structure example of a sound output module and an acoustic tube of the microphone-earphone shown in FIG. 2.
Figure 4:
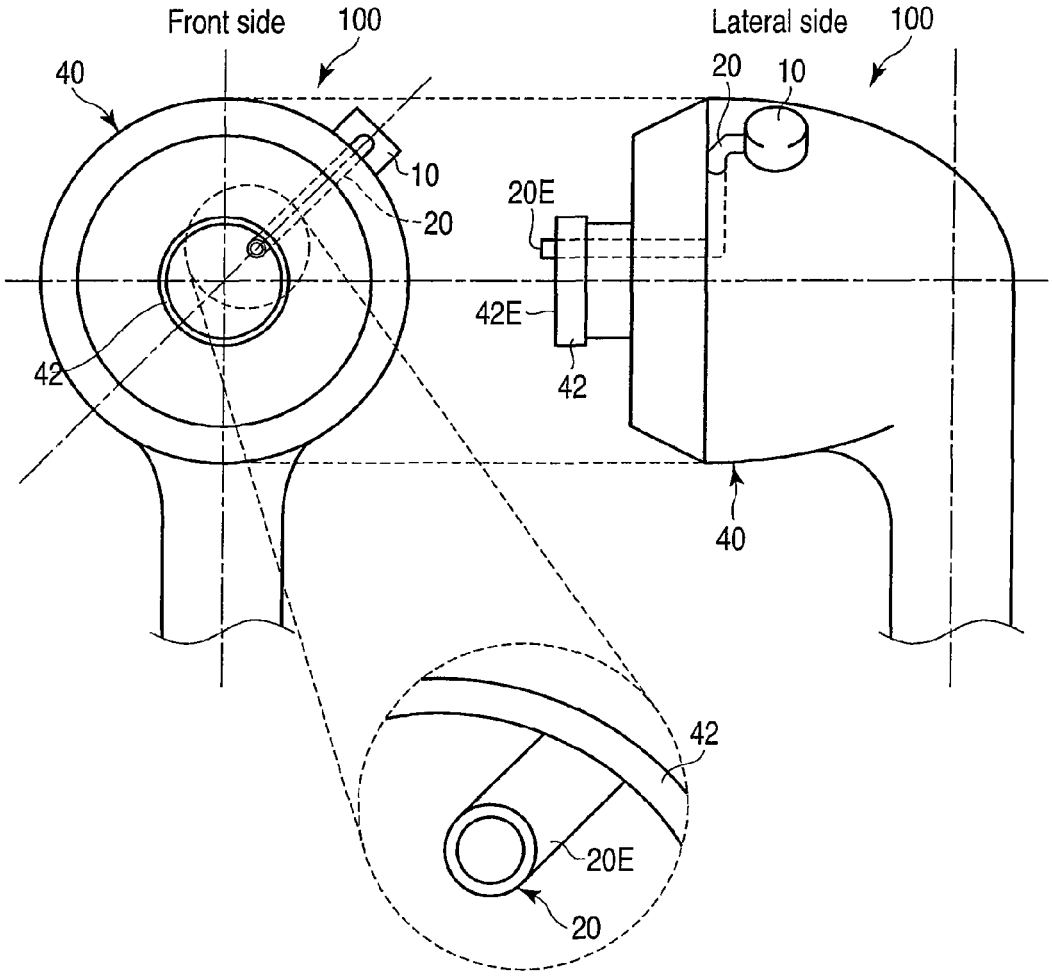
FIG. 4 is an exemplary view for describing the structure example of the sound output module and acoustic tube of the microphone-earphone shown in FIG. 2.

As shown in FIG. 3 and FIG. 4, a speaker SP is accommodated in the housing 40. The housing 40 includes an opening portion (nozzle) 42 which is open to the external auditory canal. Both the opening portion 42 of the housing 40 and the opening portion CV1 of the ear chip CV are open to, and communicate with, the external auditory canal. The speaker SP is accommodated in the cavity portion of the housing 40.

A front surface SP1 of the speaker SP and the opening portion 42 are disposed to be opposed to each other. The speaker SP produces sound in a direction from the front surface SP1 toward the opening portion 42. In the microphone-earphone of the present embodiment, the opening portion 42 has a cylindrical shape projecting in a direction from the front surface SP1 of the speaker SP toward the external auditory canal side.

As shown in FIG. 3, the acoustic tube 20 extends from the microphone device 10 toward the opening portion 42 through the housing 40, and the end 20E of the acoustic tube 20 is open from the opening portion 42. Accordingly, when the user wears the microphone-earphone, the acoustic tube 20 communicates between the external auditory canal and the microphone device 10. The acoustic tube 20 is a narrow tube with an inside diameter d which is sufficiently smaller than the diameter of each of the external auditory canal and opening portion 42.

Figure 8:
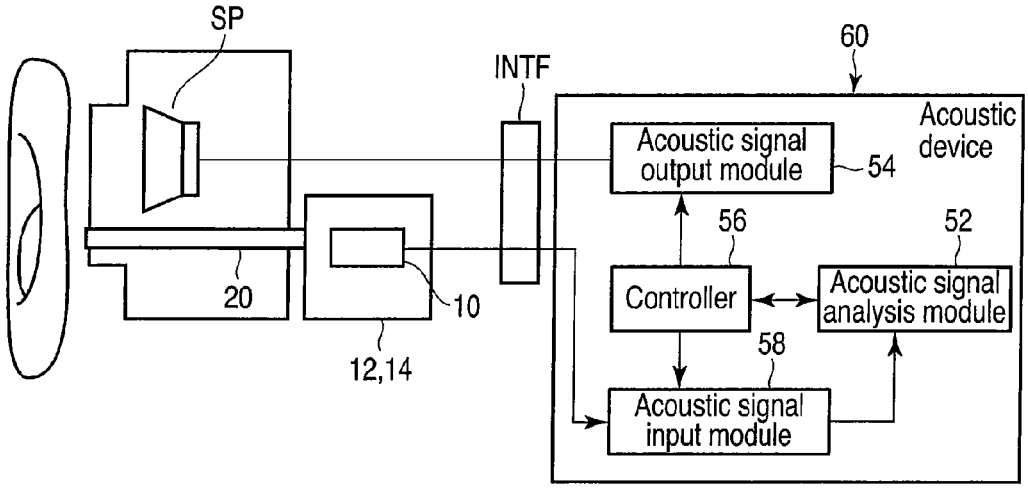
FIG. 8 is an exemplary view for describing an example of an acoustic correction process using the microphone-earphone according to the present embodiment.

Referring to FIG. 8, a description is given of an acoustic correction process using the microphone-earphone 100 of the present embodiment. The microphone-earphone 100 is connected to an acoustic device 60 having a function of measuring acoustic characteristics of the listener's external auditory canal. The acoustic device 60 comprises an acoustic signal analysis module 52, an acoustic signal output module 54, a controller 56 and an acoustic signal input module 58.

The speaker SP is connected to the acoustic signal output module 54 via the acoustic signal input/output module INTF. The microphone device 10 is connected to the acoustic signal input module 58 via the acoustic signal input/output module INTF. The controller 56 controls the operations of the acoustic signal output module 54, the acoustic signal input module 58 and the acoustic signal analysis module 52.

In order to acquire the acoustic characteristics of the external auditory canal and to calculate the filter coefficient for acoustic correction, the controller 56 inputs an electric signal for measurement to the speaker SP via the acoustic signal output module 54 and the acoustic signal input/output module INTF. The speaker SP converts the electric signal for measurement to an acoustic signal, and produces sound. The electric signal for measurement, which has been produced as sound through the opening portion 42, reaches the external auditory canal.

An acoustic signal (external auditory canal sound) from the external auditory canal, which is a response to the acoustic signal for measurement, is collected by the acoustic tube 20, and is input to the microphone device 10 as the acoustic signal. This external auditory canal sound is converted to an electric signal in the microphone device 10. The converted electric signal is input to the acoustic signal analysis module 52 via the acoustic signal input/output module INTF and the acoustic signal input module 58.

On the basis of the input electric signal corresponding to the external auditory canal sound, the acoustic signal analysis module 52 derives a filter coefficient for acoustic correction. The acoustic signal, which is output from the acoustic signal output module 54, is corrected by using the derived filter coefficient. The corrected acoustic signal, which is output from the acoustic signal output module 54, is input to the speaker SP via the acoustic signal input/output module INTF. This signal is produced as sound from the speaker SP, and the listener can enjoy the corrected acoustic signal.

As shown in FIG. 4, the acoustic tube 20 penetrates the housing 40 and extends along the wall of the housing 40. In the opening portion 42, the acoustic tube 20 is disposed near the wall of the opening portion 42. The microphone device 10 is attached to the outer surface of the housing 40. One end of the acoustic tube 20 is connected to the microphone device 10, and the other end 20E thereof is open to the external auditory canal in the vicinity of the opening portion 42.

The other end 20E of the acoustic tube 20 projects to the outside (external auditory canal side) from an end edge 42E of the opening portion 42, and substantially reaches the position of the end face of the ear chip CV. The end face of the ear chip CV corresponds to the opening plane of the opening portion CV1 of the ear chip CV, which is open to the external auditory canal (i.e. the boundary plane between the ear chip CV and the external auditory canal).

Accordingly, the acoustic tube 20 extends toward the external auditory canal such that the end 20E of the acoustic tube 20 sufficiently reaches the boundary between the external auditory canal and the ear chip CV when the user wears the microphone-earphone 100.

Figure 5:
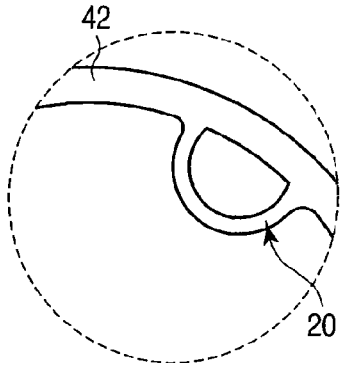
FIG. 5 is an exemplary view for describing another structure example of the acoustic tube shown in FIG. 4.

As shown in FIG. 5, the acoustic tube 20 may be formed integral with the housing 40. In FIG. 5, the opening portion 42 of the housing 40 is divided into a first opening 42A for sound output and a second opening 42B for capturing the external auditory canal sound. The space in the housing 40 is partitioned by a wall, thereby forming the acoustic tube 20 communicating between the second opening 42B and the microphone device 10. In either case, it should suffice if one end of the acoustic tube 20 is connected to the microphone device 10, and the other end 20E is open to the external auditory canal from the opening portion 42.

Figure 6:
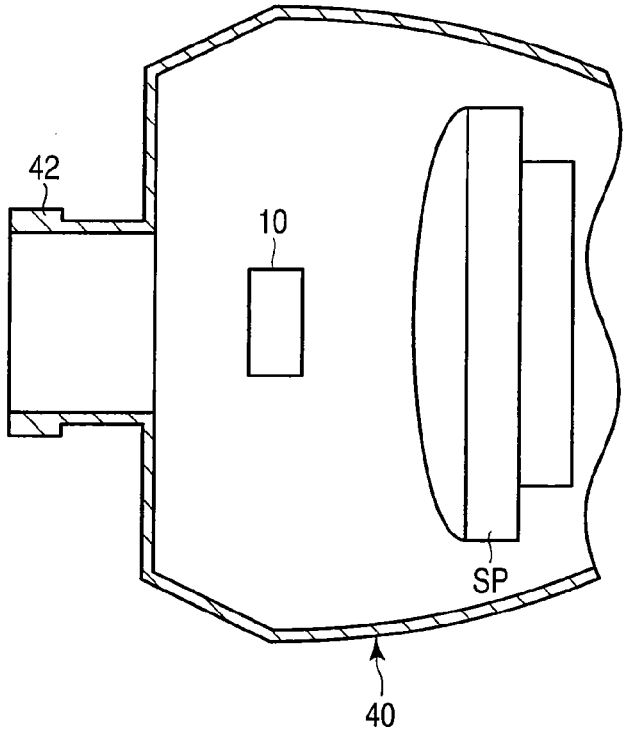
FIG. 6 shows an example of an exemplary microphone-earphone in which a microphone is disposed in front of a speaker.

The reason why the microphone device and acoustic tube are disposed as shown in FIG. 4 is explained. For example, as shown in FIG. 6, if the microphone device 10 is disposed in front of the front surface SP1 of the speaker SP (i.e. on the side where sound is output), the playback sound may be degraded, for example, since the playback sound of the speaker SP is blocked by the microphone device 10 due to occurrence of multiple reflective sound between the speaker SP and the microphone device 10.

When the external auditory canal acoustic characteristics are to be measured, a measurement signal for measuring the external auditory canal acoustic characteristics (the resonance characteristics of the external auditory canal) is output from the speaker SP. At this time, if the microphone device 10 is disposed in the housing 40, as shown in FIG. 6, the distance between the speaker SP and the microphone device 10 is short. Consequently, the acoustic signal including many components of the measurement signal, which is output from the speaker SP, is collected by the microphone device 10, and it is difficult to precisely collect the external auditory canal sound.

On the other hand, in the microphone-earphone of the present embodiment, the inside diameter d of the acoustic tube 20 is set to be sufficiently small, relative to the diameter of the external auditory canal. The inside diameter d of the acoustic tube 20 is, e.g. about 0.4 mm. In addition, the acoustic tube 20 extends toward the external auditory canal from within the housing 40 along the wall of the housing 40 such that the acoustic tube 20 reaches the boundary between the external auditory canal and the ear chip CV.

Thus, according to the microphone-earphone of the present embodiment, the playback sound, which is produced from the speaker SP, is not blocked by the acoustic tube 20 extending between the microphone device 10 and the external auditory canal, and the playback sound is not degraded. In addition, since the end 20E of the acoustic sound 20 sufficiently extends to the external auditory canal side and is open, the acoustic signal which is produced from the speaker SP is prevented from being collected by the acoustic tube 20, and it is possible to suppress lowering of the measurement precision of the external auditory canal acoustic characteristics.

The above description is directed to the embodiment including the ear chip CV. In the case of a housing having a structure without the ear chip CV, if the end of the acoustic tube is configured to reach the end of the housing, the above-described advantageous effect can be obtained. For example, it should suffice if the other end 20E of the acoustic tube 20 substantially reaches the position of the end face of the opening portion 42. In this case, the end face of the opening portion 42 corresponds to the opening plane of the opening portion 42, which is open to the external auditory canal.

Figure 7A:
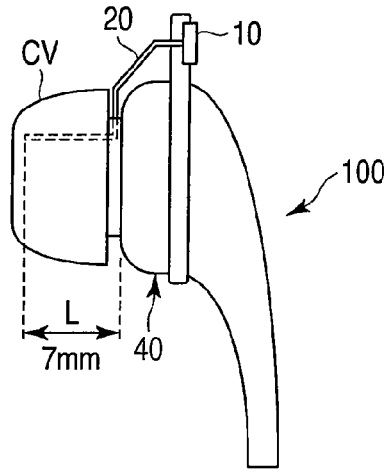
FIG. 7A is an exemplary view for describing an example of external auditory canal sound characteristics which are obtained by varying the length and diameter of the acoustic tube.
Figure 7B:
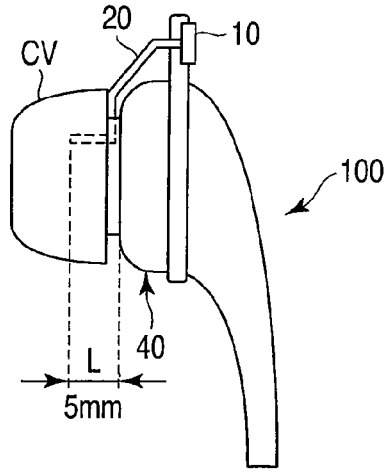
FIG. 7B is an exemplary view for describing an example of external auditory canal sound characteristics which are obtained by varying the length and diameter of the acoustic tube.
Figure 7C:
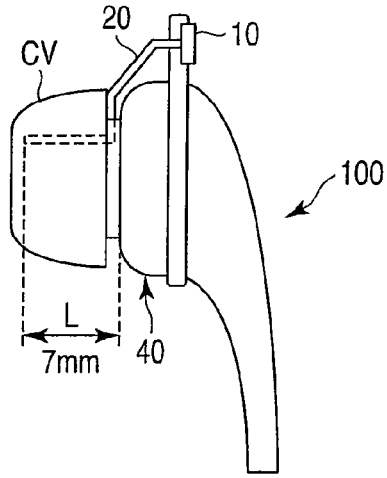
FIG. 7C is an exemplary view for describing an example of external auditory canal sound characteristics which are obtained by varying the length and diameter of the acoustic tube.

FIG. 7A to FIG. 7C show microphone-earphones 100 having different inside diameters d of acoustic tubes 20, and different lengths L of the acoustic tubes 20 extending from the position of the surface SP1 of the speaker SP toward the external auditory canal.

In the microphone-earphone 100 shown in FIG. 7A, the inside diameter d of the acoustic tube 20 is about 0.4 mm, and the length L of the acoustic tube 20 is about 7 mm. In the microphone-earphone 100 shown in FIG. 7B, the inside diameter d of the acoustic tube 20 is about 1.0 mm, and the length L of the acoustic tube 20 is about 5 mm. In the microphone-earphone 100 shown in FIG. 7C, the inside diameter d of the acoustic tube 20 is about 1.0 mm, and the length L of the acoustic tube 20 is about 7 mm.

In the microphone-earphones 100 shown in FIG. 7B and FIG. 7C, since the thick acoustic tubes 20 are used, the playback sound produced from the speaker SP is degraded. These microphone-earphones 100 are not suitable for the purpose of use with importance placed on the playback performance.

In the microphone-earphone 100 shown in FIG. 7B, the sound-collection position of the acoustic tube 20 (the position of the end 20E) is near the speaker SP. Thus, the acoustic signal including many components of the measurement signal, which is output from the speaker SP in order to measure the external auditory canal acoustic characteristics, was collected by the acoustic tube 20, and the external auditory canal acoustic characteristics with high precision could not be obtained.

On the other hand, according to the microphone-earphone 100 shown in FIG. 7A, since the inside diameter d of the acoustic tube 20 is sufficiently small, the playback sound produced from the speaker SP was not degraded. Furthermore, since the sound-collection position of the acoustic tube 20 is at a distance from the speaker SP, the external auditory canal acoustic characteristics with high precision were successfully obtained.

By using the acoustic tube 20 as described above, the microphone device 10 can be mounted at a position without influence on the characteristics of playback from the speaker SP. In addition, by using the acoustic tube 20 having such a length as to reach the external auditory canal, the sound at the boundary between the external auditory canal and the ear chip CV is collected. Thereby, the influence on the playback sound by the microphone-earphone at the time of measurement can be reduced, and the external auditory canal acoustic characteristics with high precision can be obtained. Moreover, the degradation of playback sound at the time of playback can be suppressed by making use of the acoustic tube 20 having a sufficiently smaller inside diameter d than the external auditory canal.

Therefore, the present embodiment can provide the microphone-earphone which precisely obtains the external auditory canal sound and suppresses degradation in playback sound.

Next, a description is given of a switch function for switching between the acquisition of outside sound and the acquisition of external auditory canal sound by the microphone-earphone 100 according to the embodiment. When the listener listens to playback sound by wearing the microphone-earphone on the external auditory canal, for example, in the outdoors, there is, in some cases, difficulty in listening to the playback sound due to noise from the outside. Taking this into account, in the microphone-earphone 100 according to the present embodiment, the microphone, which is used for measuring the acoustic characteristics of the external auditory canal, is also used for collecting outside noise. Thereby, there is provided an embodiment of a microphone-earphone with a rational structure, which suppresses degradation in playback sound.

Figure 9:
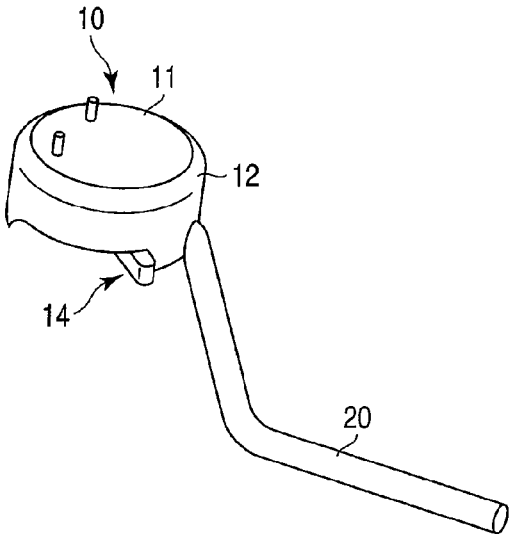
FIG. 9 is an exemplary view for describing a structure example of a microphone of the microphone-earphone shown in FIG. 1.

Specifically, FIG. 9 shows the microphone-device 10 and acoustic tube 20, which are removed from the microphone-earphone 100. The microphone device 10 comprises a microphone 11, a switch lever 14 serving as a switch module for effecting switching between the state in which outside sound can be acquired and the state in which external auditory sound can be acquired, and a microphone holder 12 which holds the microphone 11 and switch lever 14. The microphone holder 12 and the switch lever 14 are the switch module for switching the acoustic signal, which is input to the microphone 11, between the external auditory sound and the outside sound.

Figure 10:
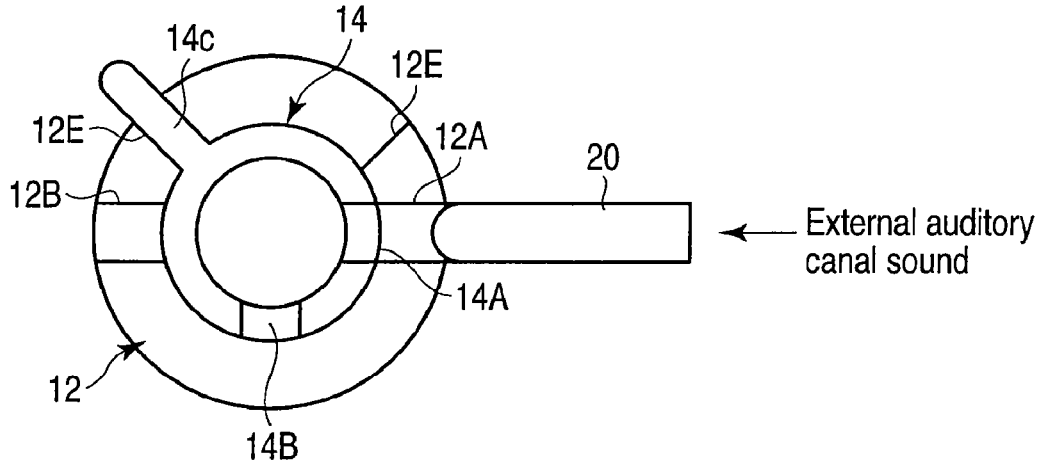
FIG. 10 is an exemplary view for describing a structure example of a switch module of the microphone shown in FIG. 9.
Figure 11:
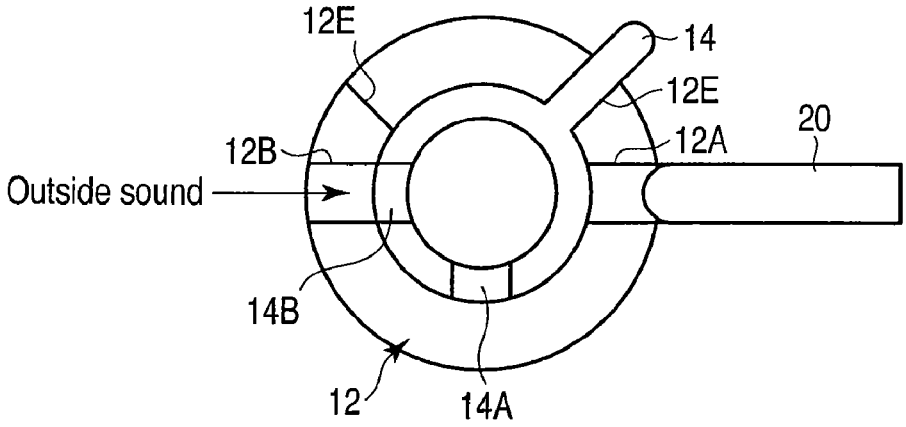
FIG. 11 is an exemplary view for describing the structure example of the switch module of the microphone shown in FIG. 9.

FIG. 10 and FIG. 11 show a structure example of the microphone device 10, as viewed from the side of the surface of attachment to the housing 40. The microphone holder 12 includes a first opening portion 12A which communicates with one end of the acoustic tube 20 and to which external auditory canal sound is input, and a second opening portion 12B which communicates with the outside and to which outside sound is input.

The switch lever 14 comprises a third opening portion 14A which is communicable with the first opening portion 12A, a fourth opening portion 14B which is communicable with the second opening portion 12B, and a lever 14C for adjusting the positions of the third opening portion 14A and fourth opening portion 14B. By operating the lever 14C, the positions of the third opening portion 14A and fourth opening portion 14B can be varied.

The microphone holder 12 is provided with a stopper 12E for restricting the movement of the lever 14C. When the lever 14C is shifted to the position where the lever 14C abuts on the stopper 12E, the first opening portion 12A communicates with the third opening portion 14A, or the second opening portion 12B communicates with the fourth opening portion 14B.

In the case shown in FIG. 10, the first opening portion 12A and the third opening portion 14A are adjusted by the lever 14C so as to communicate with each other. At this time, the second opening portion 12B and the fourth opening portion 14B do not communicate. Accordingly, external auditory canal sound is supplied as an acoustic signal to the microphone 11.

In the case shown in FIG. 11, the second opening portion 12B and the fourth opening portion 14B are adjusted by the lever 14C so as to communicate with each other. At this time, the first opening portion 12A and the third opening portion 14A do not communicate. Accordingly, outside sound is supplied as an acoustic signal to the microphone 11.

Noise cancellation can be realized by using the acoustic signal from the outside, which is obtained by operating the switch lever 14 as described above, as an input to a general noise cancel module.

The outside sound, which is obtained from the fourth opening portion 14B, is converted to an electric signal in the microphone device 10. This converted electric signal is input to an external microphone input terminal via the acoustic signal input/output module INTF. Noise cancellation can be realized, for example, by using the microphone device 10 as an external microphone unit 7 shown in FIG. 1 of the above-described Jpn. Pat. Appln. KOKAI Publication No. H3-214893.

As has been described above, according to the microphone-earphone wherein the microphone device 10 is disposed on the outside of the housing 40 and the switch function is provided for switching between the acquisition of outside sound and the acquisition of external auditory canal sound, the external auditory canal characteristics correction function and the noise canceling function can be realized by the same hardware. Specifically, according to the microphone-earphone 100 of the present embodiment, the external auditory canal sound is precisely acquired, and the microphone for use in measuring the acoustic characteristics of the external auditory canal is also used for collecting outside noise. Thereby, it is possible to provide the microphone-earphone with the rational structure, which suppresses the degradation in sound in the external auditory canal, cancels the outside noise, and suppresses the degradation in playback sound.

The present invention is not limited directly to the above-described embodiment. In practice, the structural elements can be modified and embodied without departing from the spirit of the invention. For example, the microphone-earphone 100 according to the embodiment includes the acoustic tube 20 which is separate from the housing 40, or the acoustic tube 20 which is formed integral with the housing 40. Alternatively, the speaker SP, the housing 40 and the acoustic tube 20 may be formed integral.

In this case, too, the microphone device 10 is not disposed in front of the front surface SP1 of the speaker SP, the acoustic tube 20 extending from the microphone device 10 toward the external auditory canal is provided, and the external auditory canal sound is collected by using the acoustic tube 20. Thereby, the same advantageous effects as with the microphone-earphone 100 according to the embodiment can be obtained.

Various inventions can be made by properly combining the structural elements disclosed in the embodiment. For example, some structural elements may be omitted from all the structural elements disclosed in the embodiment. Furthermore, structural elements in different embodiments may properly be combined.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The various modules of the systems described herein can be implemented as software applications, hardware and/or software modules or components on one or more computers, such as servers. While the various modules are illustrated separately, they may share some or all of the same underlying logic or code.

What is claimed is:

1. A microphone-earphone comprising:

a housing including an opening portion;

a speaker configured to be accommodated in the housing, and to produce an output toward the opening portion;

an ear chip configured to be attached to a vicinity of the opening portion, and to cover a part of an outside of the housing;

a microphone device attached to an outer surface of the housing without being covered by the ear chip; and an acoustic tube including one end connected to the microphone device and the other end which projects through the opening portion and reaches an end face of the ear chip.

2. The microphone-earphone of claim 1, wherein the ear chip comprises an opening which communicates with the opening portion and the end face corresponds to an opening plane of the opening.

3. The microphone-earphone of claim 1, further comprising:

a switch module configured to switch an acoustic signal input to the microphone device, between an external auditory sound and an outside sound.

4. The microphone-earphone of claim 2, further comprising:

a switch module configured to switch an acoustic signal input to the microphone device, between an external auditory sound and an outside sound.

5. The microphone-earphone of claim 1, wherein the acoustic tube is integral with the housing.

6. The microphone-earphone of claim 2, wherein the acoustic tube is integral with the housing.

7. The microphone-earphone of claim 3, wherein the acoustic tube is integral with the housing.

8. The microphone-earphone of claim 4, wherein the acoustic tube is integral with the housing.

* * * * *